United States Patent [19]

Oshizawa

[11] Patent Number: 4,620,259

[45] Date of Patent: Oct. 28, 1986

[54] CIRCUIT FOR DRIVING SOLENOID VALVE

[75] Inventor: Hidekazu Oshizawa, Higashimatsuyama, Japan

[73] Assignee: Diesel Kiki Co., Ltd., Japan

[21] Appl. No.: 683,715

[22] Filed: Dec. 19, 1984

[30] Foreign Application Priority Data

Dec. 20, 1983 [JP] Japan ..... 58-238932

[51] Int. Cl.[4] ..... H01H 47/32

[52] U.S. Cl. ..... 361/152; 361/160; 361/194

[58] Field of Search ..... 361/152, 153, 154, 160, 361/194

[56] References Cited

U.S. PATENT DOCUMENTS 3,149,244 9/1964 Barnes et al. ..... 361/152

*Primary Examiner*—Michael L. Gellner

*Attorney, Agent, or Firm*—Guy W. Shoup

[57] ABSTRACT

A circuit for driving a solenoid valve having a valve which is driven by an exciting current flowing through a solenoid coil to open/close the solenoid valve comprises at least one ON-OFF switch which operates in response to the movement of the valve, and a stand-by exciting current to intermittently energize the solenoid coil is supplied whereby the valve is oscillated at a position just before starting to open or close the solenoid valve. The oscillating state of the valve reduces the static frictional force that would otherwise act on the valve can be eliminated and the high speed operation of the solenoid valve can be realized.

10 Claims, 20 Drawing Figures

VST

Va

Ic
+V

Vd
0

CP

L2

L1

L3

Id

P
Pmax
P2
P02
P01
P1
0
t1
t2
t3
t4
t5
t6
t7
TIME

Pb
Pa
t10 t11
t12
Ta
t13
t14
t15
TIME

CIRCUIT FOR DRIVING SOLENOID VALVE

BACKGROUND OF THE INVENTION

1. Field of the Invention

The present invention relates to a circuit for driving a solenoid valve, and more particularly to a solenoid valve driving circuit which is capable of driving a solenoid valve at high speed.

2. Description of the Prior Art

In general, to carry out the high speed operation of a solenoid valve, a driving current with a suddenly standing-up leading edge is required. This is because of the maintenance current used for operating the solenoid valve. In the prior art, specifically in Japanese Patent Public Disclosure No. 109864/80, there is proposed a solenoid valve driving circuit in which the value of the maintenance current is kept at a level just below that required to start operation of the solenoid valve, this level being maintained regardless of any change in the voltage of the powder source or the like, so as to carry out the operation of the solenoid valve at high speed.

However, in order to keep the maintenance current at a predetermined level, the proposed circuit requires a detecting resistor for detecting the level of the maintenance current, a feedback circuit for feeding back the result of the detection by the detecting resistor and other complicated circuitry. Furthermore, the optimum level of the maintenance current varries in accordance with the temperature of the solenoid valve so that in such an arrangement where the level of the maintenance current is kept at a predetermined constant level, it is necessary to design the circuit to allow for a certain amount of variation in the maintenance current from the optimum level. Therefore, it is difficult to maintain the operation of the solenoid valve under optimum condition at all times.

SUMMARY OF THE INVENTION

It is an object of the present invention to provide an improved circuit for driving a solenoid valve.

It is another object of the present invention to provide a circuit for driving a solenoid valve which is capable of opening/closing the solenoid valve at an extremely high speed without use of complicated electronic circuitry and which is high in performance and low in cost.

It is a further object of the present invention to provide a circuit for driving a solenoid valve which enables stable open/close operation of the solenoid valve at high speed over long periods.

According to the present invention, a circuit for driving a solenoid valve having a valve which is driven by an exciting current flowing through a solenoid coil to open/close the solenoid valve comprises at least one ON-OFF switch which operates in response to the movement of the valve, a first circuit responsive to the operation of the ON-OFF switch for supplying a stand-by exciting current to intermittently energize the solenoid coil in such a way that the solenoid valve is substantially maintained in a state just before the open/close state thereof, a second circuit for supplying a driving exciting current to the solenoid coil, and means for producing a command signal for controlling the first and second circuits to make the solenoid valve open/close.

The ON-OFF switch may be constituted of a first ON-OFF switch which operates when the valve reaches a position just before starting to close the solenoid valve and a second ON-OFF switch which operates when the valve reaches a position just before starting to open the solenoid valve.

When the valve is poised for changing the solenoid valve from its open state to its closed state, the exciting current which is intermittently provided by the first ON-OFF switch is supplied as the stand-by exciting current to oscillate the valve at a position just before that in which it starts to close the solenoid valve. On the other hand, when the valve is poised for changing the solenoid valve from its closed state to its open state, the exciting current which is intermittently produced by the second ON-OFF switch is supplied as the stand-by exciting current to oscillate the valve at a position just before that in which it starts to open the solenoid valve. Of course, it is alternatively possible to provide only one or the other of the first and second ON-OFF switches so as to perform intermittent control of the exciting current stated above only when the solenoid valve is open or closed.

When the valve is oscillated at a position just before it starts to open or close the solenoid valve by the stand-by exciting current, the static frictional force that would otherwise act on the valve can be eliminated. Furthermore, if an exciting current whose level is especially high only at the time of standing-up is supplied as the driving exciting current to the solenoid coil from the second circuit, the valve can be moved with good response characteristics and high-speed operation of the solenoid valve can be realized.

Moreover, since the critical position of the valve during the waiting period is mechanically determined by the adjustment of the ON-OFF switch operated in accordance with the movement of the valve, the critical position can be exactly set and stable operation can be assured.

The invention will be better understood and the other objects and advantages thereof will be more apparent from the following detailed description of a preferred embodiment with reference to the accompanying drawings.

BRIEF DESCRIPTION OF THE DRAWINGS

FIGS. 4A to 4H are waveform diagrams for explaining the operation of the solenoid valve driving circuit shown in FIG. 3.

DESCRIPTION OF THE PREFERRED EMBODIMENT

Figure 1:
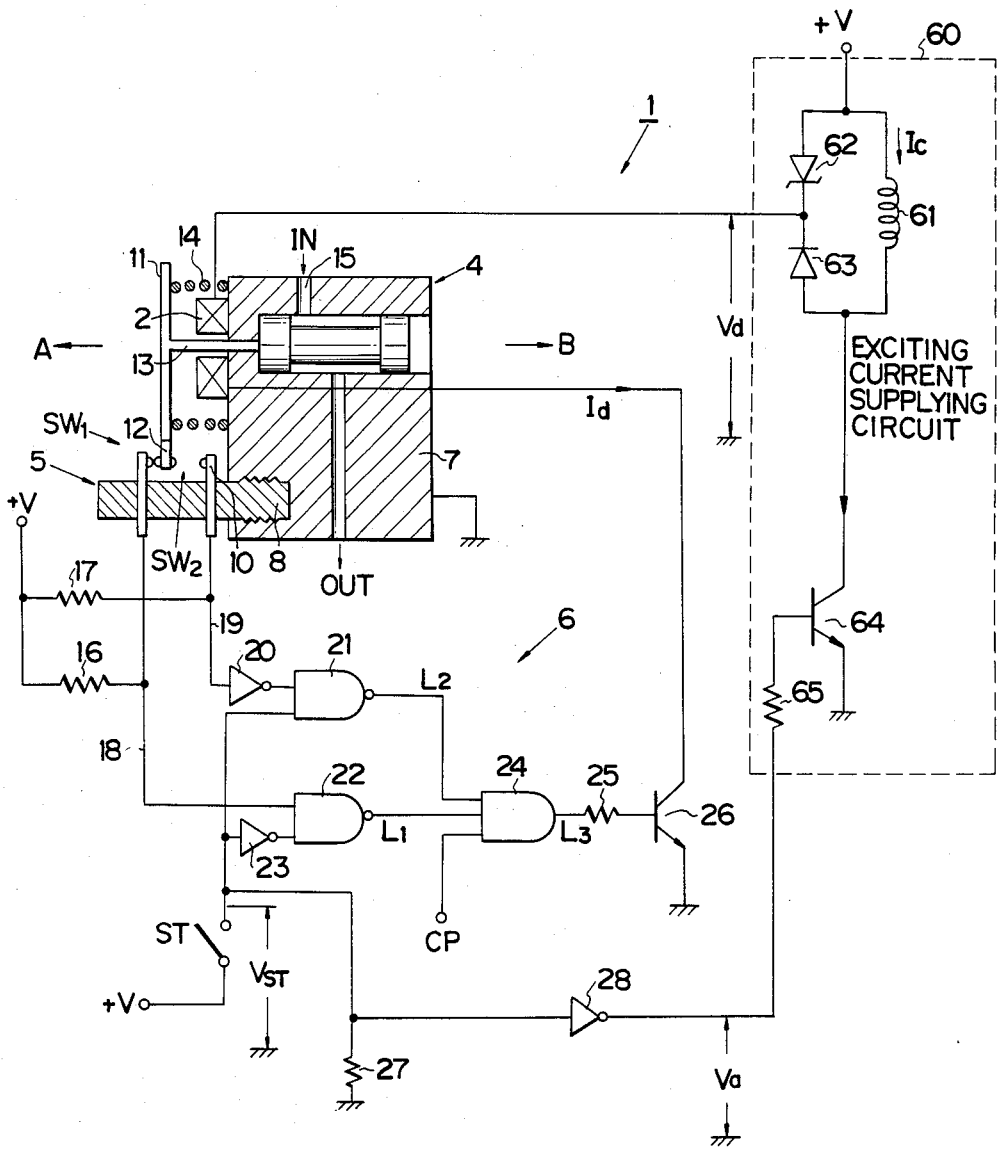
FIG. 1 is a circuit diagram of an embodiment of the solenoid valve driving circuit of the present invention, also showing a schematic diagram of the solenoid valve.

FIG. 1 shows a solenoid valve driving circuit 1 for driving a solenoid valve 4 having a conductive spool valve 3 driven to open and close at high speed by a solenoid coil 2. The solenoid valve driving circuit 1 has a switching device 5, which is turned ON and OFF in accordance with the position of the spool valve 3, and a current control circuit 6 for intermittently supplying current to the solenoid coil 2 as a stand-by exciting current in response to the ON/OFF operation of the switching device 5.

The switching device 5 consists of fixed contacts 9 and 10 which are separately fixed on a supporting member 8 made of an insulating material and rigidly mounted on a conductive body 7 of the solenoid valve 4, and a movable contact 12 which is fixed on the end portion of a spring shoe 11 and moves between the fixed contacts 9 and 10 in accordance with the movement of the spool valve 3 along its axis. The spring shoe 11 is a disk-like body fixed to the spool valve 3 by means of a rod 13. A compression coil spring 14 is provided between the spring shoe 11 and the side face of the body 7 opposite to the spring shoe 11 to bias the spool valve 3 in the direction indicated by arrow A.

When the solenoid coil 2 is deenergized, the spool valve is located at the position shown in FIG. 1 and the solenoid valve 4 is in the open state. At this time, the fixed contact 9 is in contact with the movable contact 12, which contacts together form a first switch $SW_1$. In the first switch $SW_1$, the positional relation between the fixed contact 9 and the movable contact 12 is such that the movable contact 12 separates from the fixed contact 9 to turn OFF the first switch $SW_1$ just before the spool valve 3 starts to close an inlet port 15, that is, just before the solenoid valve 4 starts to close. On the other hand, when the solenoid coil 2 is energized, the spring shoe 11, which is made of magnetic material, is drawn as far as possible in the direction shown by the arrow B against to the force of the coil spring 14, so that the inlet port 15 is completely closed by the spool valve 3, thus closing the solenoid valve 4. At this time, the movable contact 12 comes in contact with the fixed contact 10, which contacts together form a second switch $SW_2$. In this condition, the second switch $SW_2$ is turned ON while the first switch $SW_2$ is turned OFF. The second switch $SW_2$ is constituted so as to be turned OFF just before the spool valve 3 starts to open the solenoid valve 4 by the movement in the direction shown by arrow A.

Thus, the first switch $SW_1$ is switched over from ON state to OFF state at a position just before it starts to close the solenoid valve 4, while the second switch $SW_2$ is switched over from ON state to OFF state at a position just before it starts to open the solenoid valve 4.

To obtain signals indicative of the ON/OFF states of the switches $SW_1$ and $SW_2$, the fixed contacts 9 and 10 are respectively connected through resistors 16 and 17 to a voltage source +V, and the movable contact 12 is grounded through the spring shoe 11, the rod 13, the spool valve 3 and the body 7, all of which are made of a conductive material such as steel. Consequently, the levels of output lines 18 and 19 vary in accordance with the ON/OFF operations of the switches $SW_1$ and $SW_2$.

The current control circuit 6 has a NAND gate 21 having an input terminal to which the output line 19 is connected through an inverter 20 and a NAND gate 22 having an input terminal to which the output line 18 is directly connected. The voltage source +V is connected through a start switch ST to the other input terminal of the NAND gate 21, and said other input terminal of the NAND gate 21 is connected through an inverter 23 to the other input terminal of the NAND gate 22. The output terminals of the NAND gates 21 and 22 are connected to input terminals of an AND gate 24 having another input terminal to which a control pulse CP is applied. The output terminal of the AND gate 24 is connected through a resistor 25 to the base of a switching transistor 26 whose emitter is grounded. The collector of the switching transistor 26 is connected through the solenoid coil 2 to an exciting current supplying circuit 60.

The exciting current supplying circuit 60 operates in response to the closing of the start switch ST and supplies the exciting current for closing the solenoid valve 4 to the solenoid coil 2. The level of the exciting current becomes very high only at the time of standing-up. As shown in FIG. 1, the exciting current supplying circuit 60 is composed of a choke coil 61, a zener diode 62, a diode 63 a transistor 64 and a resistor 65.

A voltage signal with high level developed across a resistor 27 when the start switch ST is closed is applied to an inverter 28. The inverted output signal $V_a$ from the inverter 28 is applied through the resistor 65 to the base of the transistor 64. Therefore, the transistor 64 is turned from ON to OFF when the start switch ST is closed. As a result, the steady-state current flowing through the choke coil 61 when the transistor 64 is ON is suddenly cut off and a large counter electromotive force is developed in the choke coil 61. The current $I_c$ due to this counter electromotive force flows in the closed circuit consisting of the choke coil 61, the zener diode 62 and the diode 63. At this time, since counter electromotive force of more than a predetermined level is cut off by the zener diode 62, the voltage developed across the choke coil 61 due to the counter electromotive force is suppressed to less than the level determined by the characteristics of the zener diode 62. The voltage $V_b$ is superposed on the voltage source +V and the resulting voltage $V_d$ is applied to the solenoid coil 2.

The operation of the solenoid valve driving circuit 1 shown in FIG. 1 will now be described with reference to FIG. 2. When the power source voltage is applied to the solenoid valve driving circuit 1 by closing a power switch (not shown) at the time $t_1$, since the level of the control pulse CP is low, the switching transistor 26 is OFF and the solenoid coil 2 is deenergized. At this time, since the start switch ST is OFF, the level of the potential $V_{ST}$ is low, so that the level of the voltage $V_a$ is high (FIGS. 2A, 2B and 2E). As a result, the transistor 64 of the exciting current supplying circuit 60 is ON and the current $I_c$ starts to flow through the choke coil 61 at the same time the source voltage is applied thereto. The waveform of the current $I_c$ is shown in FIG. 2C. Therefore, the solenoid valve 4 is open.

Since the start switch ST is OFF and the first switch $SW_1$ is ON and the second switch $SW_2$ is OFF at $t_2$, the output levels of the NAND gates 21 and 22 are high. Therefore, when the level of the control pulse CP becomes high at $t_2$, the transistor 26 is turned ON and the exciting current starts to flow through the zener diode 62 to the solenoid coil 2. As a result, the spool valve 3 moves in the direction indicated by the arrow B. However, since the first switch $SW_1$ opens at $t_3$ just before the spool valve 3 starts to close the solenoid valve 4, the level of the output line 18 becomes high and the output level $L_1$ of the NAND gate 22 becomes low. Consequently, the output level $L_3$ of the AND gate 24 also becomes low. Therefore, although the exciting current $I_d$ starts to flow through the solenoid coil 2 at $t_2$, it is cut off at $t_3$ (FIGS. 2G, 2H and 2I).

Figures 2A, 2B, 2C, 2D, 2E, 2F, 2G, 2H, 2I, 2J:
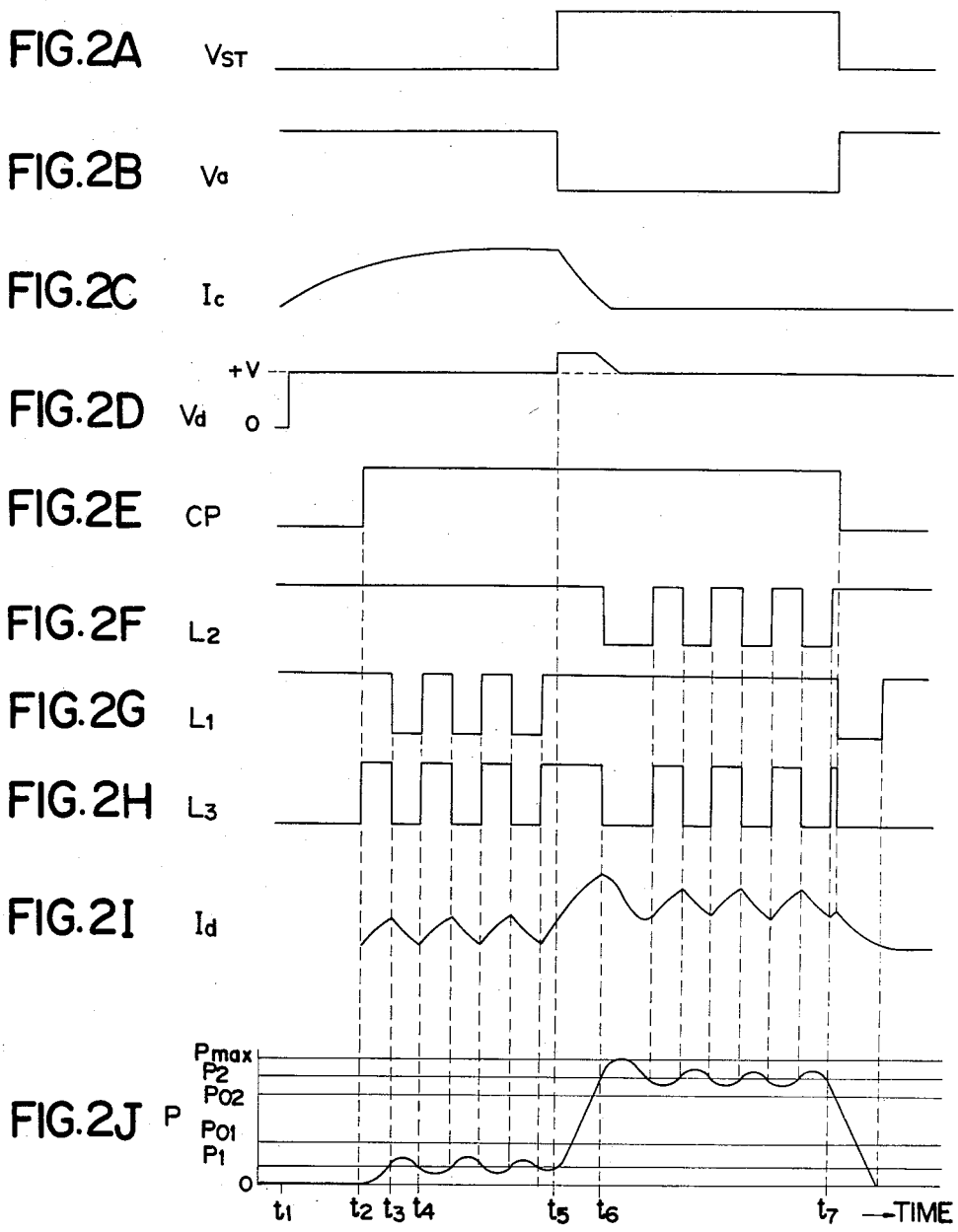
FIGS. 2A to 2J are waveform diagrams for explaining the operation of the solenoid valve driving circuit shown in FIG. 1.

FIG. 2J shows the variation in position of the spool valve 3 shown in FIG. 1 with time taken along the abscissa and the position P of the spool valve 3 taken on ordinate. The position of the spool valve 3 in FIG. 1 is defined as position $P=0$. The first switch $SW_1$ is changed from ON to OFF at $P=P_1$, the second switch $SW_2$ is changed from OFF to ON at $P=P_2$, and the position $P_{max}$ is the position when the spool valve 3 is moved as far as possible in the direction shown by arrow B. Furthermore, $p \geqq P_{02}$, for closed condition of the solenoid valve 4, $P \leqq P_{01}$ for open condition of the solenoid valve 4, and $P_{01} < P < P_{02}$ for transient condition of the solenoid valve in the open/close state.

As will be understood from the above description, the spool valve 3 starts to move in the direction shown by the arrow B when the exciting current $I_d$ starts to flow at the time $t_2$, and the spool valve 3 moves beyond the position $P_1$ due to inertia even when the exciting current $I_d$ is cut off at the time $t_3$. Then, it follows that the spool valve 3 starts to move in the direction shown by arrow A slightly after the time $t_3$. As a result, the first switch $SW_1$ is closed again at the time $t_4$ slightly after $t_3$ and the output levels $L_2$ and $L_3$ become high.

Therefore, the exciting current $I_d$ starts to flow again, whereafter the same operation as described above is repetitively carried out. As described above, since the exciting current $I_d$ is intermittently supplied in accordance with the ON/OFF state of the first switch $SW_1$, the spool valve 3 oscillates with small amplitude near the position $P_1$ as shown in FIG. 2J.

In this case, when the start switch ST is closed at the time $t_5$ and the potential $V_{ST}$ on the output side of the start switch ST becomes high (FIG. 2A), the output level $L_1$ of the NAND gate 22 is maintained at a high level regardless of the level of the output line 18. When the start switch ST is closed, the transistor 64 is turned OFF. Thus, the level of the voltage $V_d$ suddenly becomes larger than the level of the voltage source $+V$ by the level of the voltage produced by the counter electromotive force, whereafter with the passage of time the level of the voltage $V_d$ falls to approach the level of the voltage source $+V$ (FIG. 2D). The waveform of the current $I_c$ at this time is shown in FIG. 2C. As a result, the exciting current $I_d$ flowing through the solenoid coil 2 at this time tends to overshoot, as shown in FIG. 2I, so that the spool valve 3 can be moved at extremely high speed. In this case, even if the spool valve 3 moves in the direction of arrow B as described above and the first switch $SW_1$ is turned OFF, the energization of the solenoid coil 2 is continued, so that the spool valve 3 reaches the position $P_2$ for a short time to close the solenoid valve 4.

When the spool valve 3 reaches the position $P_2$ at high speed as described above, the second switch $SW_2$ is closed at the time $t_6$, so that the output level of the inverter 20 becomes high and the output level $L_2$ of the NAND gate 21 becomes low. Since the NAND gate 22 receives low level signals from the inverter 23 at this time, the output level $L_1$ of the NAND gate 22 is maintained at high level (FIG. 2G). Therefore, it follows that the exciting current to the solenoid coil 2 is cut off at the time $t_6$ and the spool valve 3 is returned in the direction shown by arrow A under the force of the coil spring. However, when the spool valve 3 moves in the direction of arrow A beyond the position $P_2$, the second switch $SW_2$ is turned OFF and the exciting current is again supplied to the solenoid coil 2. This ON/OFF operation of the exciting current is similar to that carried out at position $P_1$, and the position of the spool valve 3 is maintained by the ON/OFF operation in such a way that the solenoid valve 4 is maintained in a state just prior to opening.

When the start switch ST is turned OFF and the level of the control pulse CP becomes low at the time $t_7$, the output level $L_3$ becomes low. As a result, the solenoid coil 2 is maintained in the deenergized state and the solenoid valve 4 opens.

With this structure, since the exciting current is intermittently supplied while the solenoid valve 4 is open and the spool valve 3 oscillates with small amplitude in a position just before the solenoid valve 4 starts to close, no static frictional force arises between the spool valve 3 and the body 7. Thus, when the start switch ST is turned ON, the spool valve 3 can be moved at high speed in the direction shown by arrow B.

Furthermore, since the output voltage of the exciting current supplying circuit 60 momentarily rises above the source voltage and a large level of exciting current suddenly flows when the start switch ST is turned on, the spool valve 3 moves to the position for closing the solenoid valve 4 very quickly, so that it is possible to quickly close the soleoid valve 4.

In addition, the effect of eliminating the static frictional force of the spool valve 3 is also had when the solenoid valve 4 is changed from its closed state to its open state. Furthermore, since the stand-by position of the spool valve 3 is determined by the first and second switches $SW_1$ and $SW_2$, the position of the spool valve 3 during stand-by can be set very easily and exactly. Thus, erroneous opening or closing of the solenoid valve 4 from the stand-by state is securely prevented, and it is possible to always position the spool valve 3 at the desired critical position $P_1$ or $P_2$.

Figure 3:
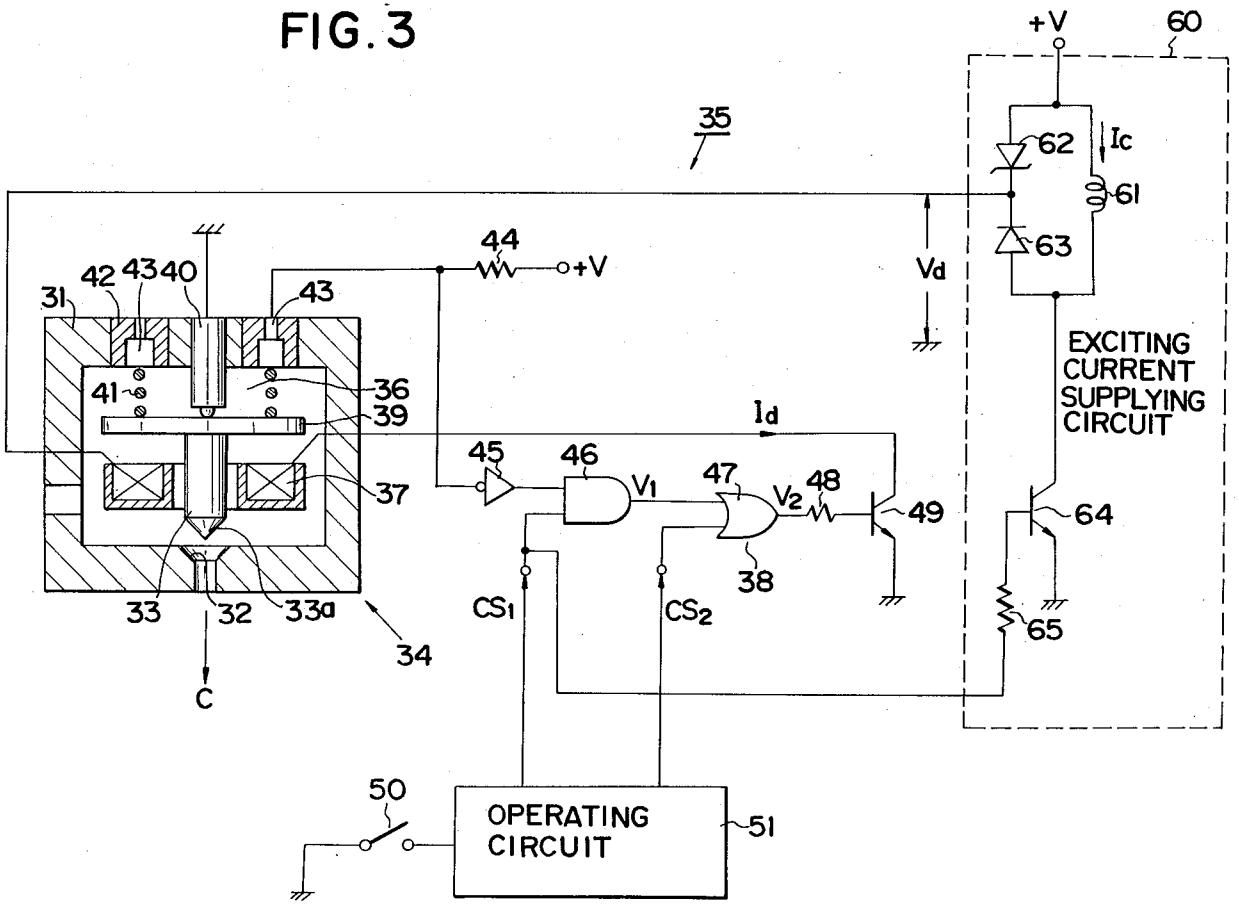
FIG. 3 is a circuit diagram of another embodiment of a solenoid valve driving circuit of the present invention, also showing a schematic diagram of the solenoid valve.

FIG. 3 shows another embodiment of the solenoid valve driving circuit of the present invention. The solenoid valve driving circuit 35 shown in FIG. 3 is a circuit for driving a solenoid valve 34 which is opened/closed by the seating of the tip portion $33_a$ of the valve 33 on a valve seat 32 defined either in a casing 31 (as shown) or separate therefrom.

The solenoid valve driving circuit 35 has a switch 36 which is turned ON or OFF in response to the position of the valve 33 and a current control circuit 38 for intermittently supplying exciting current to a solenoid coil 37 of the solenoid valve 34 in response to the ON/OFF operation of the switch 36. The intermittent current from the current control circuit 38 is supplied to the solenoid coil 37 as a stand-by exciting current.

The switch 36 is composed of a disk-shaped conductive spring shoe fixed at the rear end portion of the valve 33 and a fixed electrode 40 rigidly mounted on the conductive casing 31. A tension coil spring 41 is provided between the spring shoe 39 and the casing 31 to bias the valve 33 so as to be separated from the valve seat 32. The tension coil spring 41 is electrically conductive and one end thereof is in contact with a terminal 43 fixed through an insulating layer 42 to the casing 31. When the solenoid coil 37 is deenergized, the solenoid valve 34 is in open state and the switch 36 is ON. On the other hand, when the solenoid coil 37 is energized, the valve 33 moves against the force of the tension coil spring 41 in the direction shown by arrow C (in the direction of closing the solenoid valve 34), and the switch 36 is turned OFF. The switch 36 is turned from ON to OFF when the valve 33 is at a position just before starting to close the solenoid valve 34.

To obtain a signal indicative of the ON/OFF state of the switch 36, the electrode 40 is grounded and the source voltage $+V$ is applied through a resistor 44 to the terminal 43. Therefore, the potential at the terminal 43 becomes ground level when the switch 36 is ON and as soon as a high level state equal to that of the source voltage +V when the switch 36 is OFF.

The current control circuit 38 has an inverter 45 to which the potential of the terminal 43 is applied, an AND gate 46 to one input terminal of which the output terminal of the inverter 45 is connected, and an OR gate 47 to one input terminal of which the output terminal of the AND gate 46 is connected. The output terminal of the OR gate 37 is connected through a resistor 48 to the base of a transistor 49 whose emitter is grounded. The collector of the transistor 49 is connected through the solenoid coil 37 to the exciting current supplying circuit 60, which is of the same construction as that shown in FIG. 1. The elements of the exciting current supplying circuit 60 are designated by the same reference number as those in FIG. 1.

A first control signal $CS_1$ shown in FIG. 4A is applied to the other input terminal of the AND gate 46 and a second control signal $CS_2$ shown in FIG. 4B is applied to the other input terminal of the OR gate 47. The first and second control signal $CS_1$ and $CS_2$ are derived from an operating circuit 51 to which is connected a switch 50 for use in the operation for closing the solenoid valve 34.

The operation of the solenoid valve driving circuit 35 shown in FIG. 3 will be now described with reference to FIGS. 4A to 4H.

When the voltage source is applied thereto at the time $t_0$ and the switch 50 is open, the level of the first control signal $CS_1$ becomes high to open the AND gate 46 and the output voltage $V_1$ (FIG. 4C) of the AND gate 46 becomes high level because of the ON state of the switch 36. Consequently, the output voltage $V_2$ of the OR gate 47 becomes high level even if the level of the second control signal $CS_2$ is low (FIG. 4D). As a result, the transistor 49 is turned ON and the exciting current $I_d$ flows through the solenoid coil 37 (FIG. 4E). The level of the exciting current $I_d$ increases with the passage of time, and the valve 33 moves in the direction shown by arrow C against to the force of the coil spring 41. However, when the valve 33 comes to a predetermined position just before starting to close the solenoid valve 34, the switch 36 is turned OFF. As a result, the output level of the inverter 45 becomes low and the level of the output voltage $V_1$ becomes low to turn OFF the transistor 49.

Figure 4H:
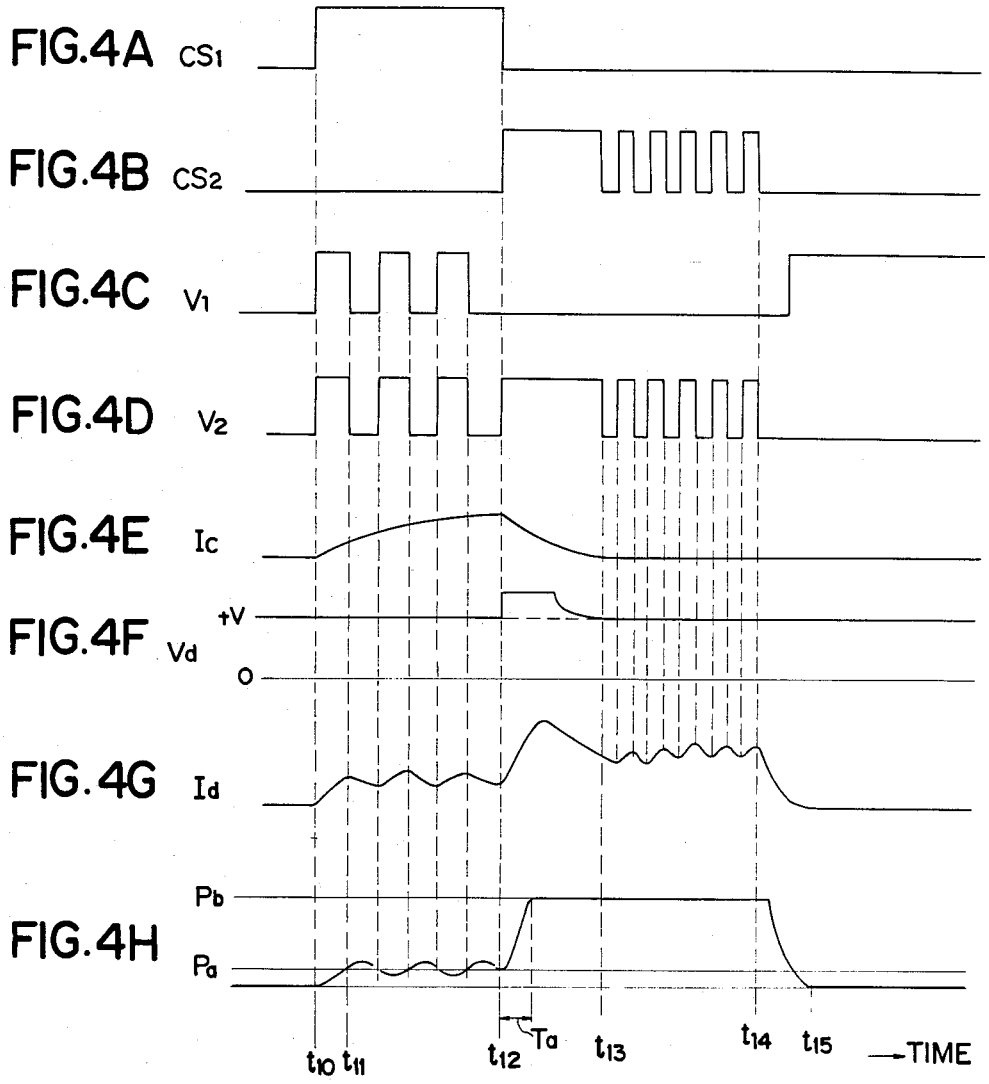

In FIG. 4H, the position P of the valve 33 is taken along the ordinate and the predetermined position mentioned above is shown in $P_a$. The valve 33 reaches the position $P_a$ for the first time after time $t_{10}$ at the time $t_{11}$. Since the transistor 49 is turned OFF at this time and the exciting current $I_d$ is cut off, the valve 33 is returned by the force of the spring 41. As a result, the switch 36 is turned ON again and the exciting current $I_d$ flows. The operation described above is similar to the operation described with respect to FIG. 1 for intermittently supplying the exciting current by the use of the first switch $SW_1$. By this operation, the exciting current $I_d$ flows intermittently as the stand-by exciting current, so that the valve 33 oscillates with small amplitude near the position $P_a$ and the solenoid valve 34 is maintained in the open state.

When the switch 50 is closed at the time $t_{12}$ in order to close the solenoid valve 34, the level of the first control signal $CS_1$ becomes low and that of the second control signal $CS_2$ becomes high. Consequently, the level of the output voltage $V_2$ becomes high regardless of the level of the output voltage $V_1$ of the AND gate 46, so that the transistor 49 is turned ON. At the same time, the exciting current supplying circuit 60 operates in a similar way to the embodiment shown in FIG. 1 and a large exciting voltage due to the counter electromotive force induced in the choke coil 61 is superposed on the source voltage +V (FIG. 4F) to obtain the voltage $V_d$. As a result, the level of the exciting current $I_d$ suddenly increases after the time $t_{12}$ (FIG. 4G). In addition, the waveform of the current $I_c$ flowing through the choke coil 61 is shown in FIG. 4E. Therefore, the valve 33 rapidly moves to the position $P_b$ where the tip portion $33_a$ of the valve 33 is seated on the valve seat 32, thus closing the solenoid valve 34.

At a time $t_{13}$, a predetermined period after the time $t_{12}$, the second control signal $CS_2$ is changed to a pulse signal with a predetermined duty ratio determined to maintain the solenoid valve 34 in its closed state with less power. This is possible since it is a characteristic of a solenoid valve that once closed it can be maintained in that condition using less power than was required for closing it.

When the level of the second control signal $CS_2$ becomes low at time $t_{14}$, the transistor 49 is turned OFF and the level of the exciting current $I_d$ is decreased in accordance with a predetermined curve. With the decrease of the exciting current, the position of the valve 33 is returned to its original (uppermost) position at time $t_{15}$.

With the structure described above, since the valve 33 oscillates with small amplitude near the critical position $P_a$ as shown in FIG. 4H between times $t_{11}$ and $t_{12}$, there is no static frictional resistance between the valve 33 and the associated guide member 52 during this period. Therefore, when the closing operation of the solenoid valve 34 is commanded by the second signal $CS_2$, the valve 33 can move in the direction shown by arrow C very rapidly. Thus, when the switch 50 is closed and the large exciting current is momentarily supplied by the exciting current supplying circuit 60, the valve 33 quickly moves to the position for closing the solenoid valve. As a result, it is possible to reduce the time $T_a$ required for moving the valve 33 to the position $P_a$ after the switch 50 is closed, and the solenoid valve can be closed in a very short time. Features similar to those of the embodiment shown in FIG. 1 can also be obtained with the embodiment shown in FIG. 3.

When the maximum level of the transient voltage is suppressed by the zener diode 62 as described above, the electromagnetic interference to other electronic equipment can be remarkably reduced and the efficiency of the circuit is increased due to the suppression of noise energy. Moreover, the width of the pulse-like voltage superposed on the voltage +V becomes wider and the leading edge of the exciting current I becomes sharper to make it possible to operate the solenoid at high speed.

I claim:

1. A circuit for driving a solenoid valve having a valve which is driven by a current flowing through a solenoid coil to open or close said solenoid valve, comprising:

an ON-OFF switching means which operates in response to the movement of said valve;

means for producing a command signal for controlling the open/close state of said solenoid valve;

a first circuit responsive to a command signal and the operation of said ON-OFF switching means for providing a supply of a stand-by exciting current which intermittently energizes said solenoid coil in such a way that said solenoid valve is substantially maintained in a state just before the open/close state thereof; and a second circuit responsive to said command signal for supplying a driving exciting current to said solenoid coil to drive said valve to the fully open or closed state of said solenoid valve.

2. A circuit for driving a solenoid valve as claimed in claim 1 wherein said stand-by exciting current is an intermittent current produced in response to the ON/-OFF operation of said ON-OFF switching means, whereby said valve is oscillated at a position just before starting to open or close said solenoid valve.

3. A circuit for driving a solenoid valve as claimed in claim 1, wherein said driving exciting current suddenly becomes large at the time of standing-up in response to said command signal.

4. A circuit for driving a solenoid valve as claimed in claim 1 wherein said ON-OFF switching means has a first switch which turns ON and OFF at a position of said valve just before said valve starts to close said solenoid valve and a second switch which turns ON and OFF at a position of said valve just before said valve starts to open said solenoid valve.

5. A circuit for driving a solenoid valve as claimed in claim 4 wherein said first circuit has a circuit for producing a first signal whose level varies in response to the ON-OFF operation of said first switch, a circuit for producing a second signal whose level varies in response to the ON-OFF operation of said second switch, a circuit means responsive to said first and second signals and said command signal for supplying said stand-by exciting current in order to maintain said valve in a position just before starting to open or close said solenoid valve.

6. A circuit for driving a solenoid valve as claimed in claim 3 wherein said second circuit has a power switch which is turned ON and OFF in response to said command signal, a choke coil connected through said power switch to a d.c. voltage source, a uni-directional element connected between one end of said choke coil and said solenoid coil in order to apply to said solenoid coil a counter electromotive force produced in said choke coil when said power switch is turned ON in response to said command signal, and a voltage limiting element for limiting the level of the transient voltage applied to said solenoid coil through said uni-directional element and for applying the voltage of said d.c. voltage source to said solenoid coil, said voltage limiting element being connected between said solenoid coil and said d.c. current voltage source.

7. A circuit for driving a solenoid valve as claimed in claim 1 wherein said ON-OFF switching means is constituted to turn ON/OFF when said valve is at a position just before opening/closing said solenoid valve.

8. A circuit for driving a solenoid valve as claimed in claim 7 wherein said first circuit has a circuit means for generating a voltage signal corresponding to the ON-OFF operation of said ON-OFF switching means, and a current switching means responsive to the voltage signal from said circuit means for intermittently supplying a current from a d.c. voltage source as said stand-by exciting current in accordance with the operation of said ON-OFF switch means, whereby said valve is oscillated at position just before starting to close said solenoid valve.

9. A circuit for driving a solenoid valve as claimed in claim 8, further comprising means responsive to said command signal for supplying a current for continuously exciting said solenoid coil so as to maintain the solenoid valve in the closed state when the closing of said solenoid valve is commanded.

10. A circuit for driving a solenoid valve as claimed in claim 8, further comprising a circuit for supplying a pulse signal to said solenoid coil for maintaining the solenoid valve in the closed state after the operation for closing said solenoid valve by said command signal.

* * * * *